United States Patent [19]

Rotzler

[11] Patent Number: 4,552,294

[45] Date of Patent: Nov. 12, 1985

[54] GRIPPING FEEDER FOR STRIP OR WIRE STOCK

[75] Inventor: Frank Rotzler, Maulbronn, Fed. Rep. of Germany

[73] Assignee: R W M-Raster-Werkzeugmaschinen GmbH, Oetisheim, Fed. Rep. of Germany

[21] Appl. No.: 556,086

[22] Filed: Nov. 29, 1983

[30] Foreign Application Priority Data

Dec. 18, 1982 [DE] Fed. Rep. of Germany ..... 3247001

[51] Int. Cl.[4] ..... B65H 17/36; B65H 17/44

[52] U.S. Cl. ..... 226/142; 226/145; 226/149; 226/162; 226/167

[58] Field of Search ..... 226/141, 142, 149, 160, 226/161, 165, 163, 158, 167, 162, 146, 145

[56] References Cited

U.S. PATENT DOCUMENTS

| | | | |
|---|---|---|---|
| 387,710 | 8/1888 | Crecelius | 226/160 X |
| 1,495,508 | 5/1924 | Campbell | 226/141 X |
| 1,946,874 | 2/1934 | Nicholas | 226/142 |
| 2,468,236 | 4/1949 | Rue | 226/149 X |
| 2,825,560 | 3/1958 | Danly et al. | 226/161 |
| 2,884,119 | 4/1959 | Powers | 226/163 |
| 3,161,338 | 12/1964 | Grimm | 226/163 |
| 3,435,717 | 4/1969 | Macomber | 226/163 X |
| 3,784,075 | 1/1974 | Portmann | 226/163 X |
| 4,316,569 | 2/1982 | Gentile | 226/158 |

OTHER PUBLICATIONS

Dennis, R. E., IBM Technical Disclosure Bulletin, vol. 11, No. 7, Dec. 1968.

*Primary Examiner*—Harvey C. Hornsby
*Assistant Examiner*—Scott J. Haugland
*Attorney, Agent, or Firm*—Balogh, Osann, Kramer, Dvorak, Genova & Traub

[57] ABSTRACT

This invention relates to a gripping feeder for an intermittent feeding of strip or wire stock in presses, stamping machines or similar machines. It is an object of the invention to provide such gripping feeder which permits a change of the stroke length to be effected from the outside while the machine is in operation and permits such change to be effected manually or by means of an adjusting motor and also permits an automatic adaptation of the feeding and retaining grippers to the thickness of the strip or wire stock to be fed. This is accomplished in that the carriage carrying the feeding gripper is adapted to be driven from the main drive of the machine via a feed rocker, which extends transversely to the direction of travel of the carriage and is fulcrumed on a slider, which is slidable along a rail that extends transversely to the direction of travel of the carriage so that an adjustment of the slider along said rail will result in a change of the stroke length of the carriage. The feed rocker fulcrumed on the slider is preferably adapted to have an oscillating angular motion about its fulcrum imparted to it by a pivoted finger, to which an angular oscillation is imparted from the main drive, and which is pivoted to one arm of the feed rocker, the other arm of which is connected to the carriage by a link for imparting a reciprocating linear movement to the carriage.

3 Claims, 8 Drawing Figures

Figure 1:
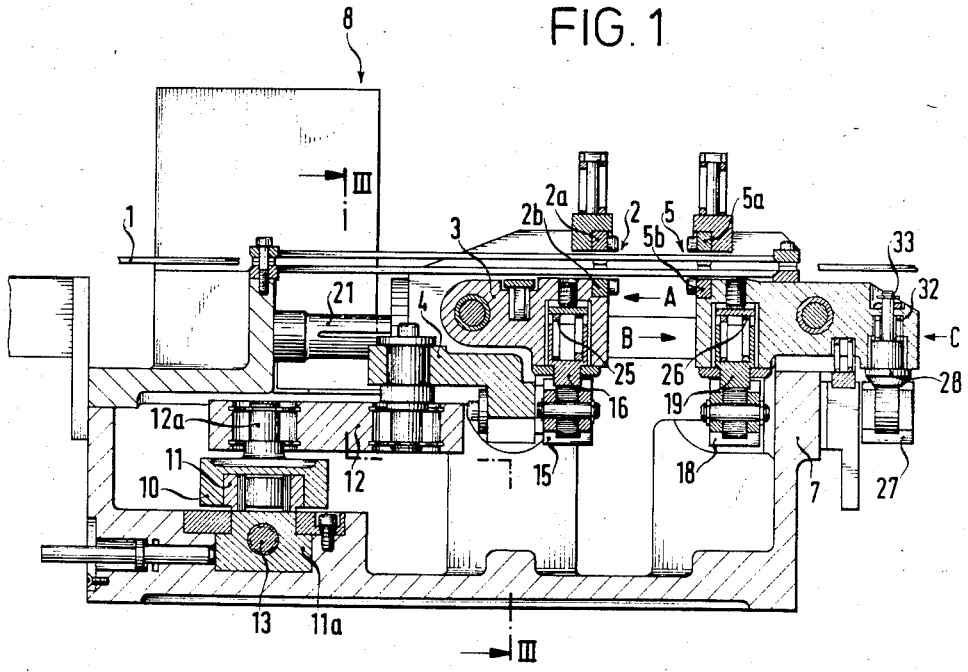

FIG. 3
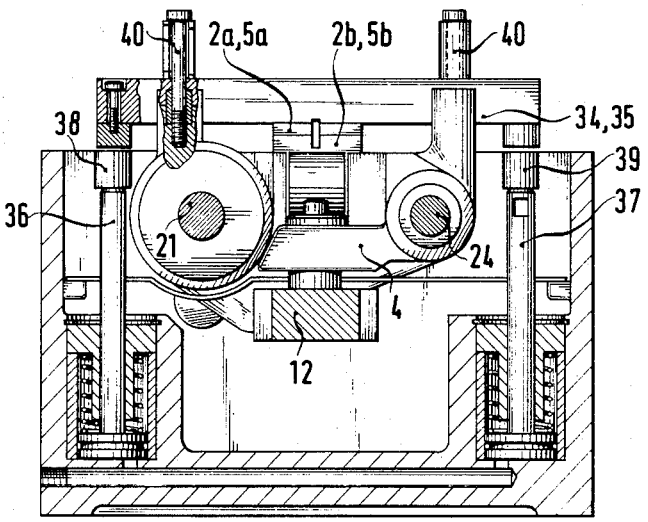
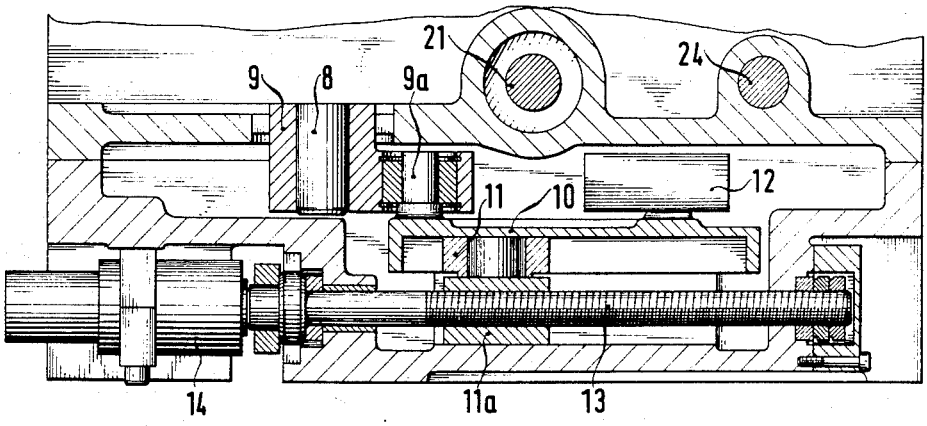
FIG. 4

GRIPPING FEEDER FOR STRIP OR WIRE STOCK

This invention relates to a gripping feeder for an intermittent feeding of wire or strip stock in presses, stamping machines and other machines.

Known gripping feeders for such purposes are driven from the main shaft of the machine via angle gear trains and an interposed telescopic shaft and are operated in step with the machine. That drive mechanism is connected to a reciprocating feeding gripper, which cooperates with a stationary retaining gripper. Said two grippers are opened and closed in phase opposition to each other and the feeding gripper is mounted on a carriage behind the retaining gripper.

In the known gripping feeders comprising a stationary retaining gripper and a reciprocating carriage carrying a feeding gripper, a change of the feed increment cannot be effected unless the machine is shut down. For various manufacturing operations the feed increment must be corrected while the machine is in operation; this is not possible with the known gripping feeders just described.

It is an object of the invention to provide for an intermittent feeding of strip or wire stock in presses, stamping machines or other machines a gripping feeder which permits a change of the feed increment from the outside while the machine is in operation and which permits such change to be effected by hand or by means of an adjusting motor, and which feeder permits also an automatic adaptation of the feeding and retaining grippers to the thickness of the strip or wire which is to be fed.

In a gripping feeder for an intermittent feeding of wire or strip stock in presses, stamping machines and other machines, comprising a stationary retaining gripper, a reciprocating feeding gripper disposed behind the retaining gripper, a carriage carrying the feeding gripper, and means for opening and closing the retaining and feeding grippers in phase opposition to each other, said object is accomplished in accordance with the invention in that the carriage carrying the feeding gripper is adapted to be driven from the main drive of the machine via a feed rocker, which extends transversely to the direction of travel of the carriage and is fulcrumed on a slider, which is slidable along a rail that extends transversely to the direction of travel of the carriage so that an adjustment of the slider along said rail will result in a change of the stroke length of the carriage. The pivoted frame carrying the adjustable slider is preferably adapted to have an oscillating angular motion about its fulcrum imparted to it by a pivoted finger, to which an angular oscillation is imparted from the main drive and which is pivoted to one arm of the feed rocker, the other arm of which is connected to the carriage by a link for imparting a reciprocating linear movement to the carriage.

By an adjustment of the slider along the transverse rail, the feed increment can be changed from the outside during operation and that change can be effected by hand or by means of a motor, e.g., in that the slider is adjusted by means of a screw. An automatic correction can be effected by means of a microcomputer controlled by a measuring system.

The carriage may be provided with a pivoted gripping arm, which constitutes the movable jaw of the feeding gripper, and said movable jaw may be movable between closed and open positions under the control of a first plunger, which bears at one end on the movable jaw and at the other end on one arm of a first cam follower rocker, the other arm of which cooperates with a first camwheel for imparting an opening movement to the feeding gripper, whereas a gripping rocker fulcrumed to the housing of the feeder constitutes the movable law of the retaining gripper, which is movable between closed and open positions under the control of a second plunger, which bears at one end on the movable jaw of the retaining gripper and at the other end on one arm of a second cam follower rocker, the other arm of which cooperates with a second camwheel for imparting an opening movement to the movable jaw of the retaining gripper. In such an arrangement an adjusting shaft is provided, which is driven from the main drive of the machine and carries the first camwheel, which is axially slidably and non-rotatably mounted on said shaft, and the second camwheel, which is axially immovably and non-rotatably mounted on said shaft, which together with a guide rod that is parallel to said shaft serves to guide the carriage, and each of the first and second plungers bearing on said first and second cam follower rockers and on said pivoted arm and gripping rocker arm, respectively, consists of two end portions and of a compression spring, which is interposed between said end portions and ensures that said movable jaws will engage the stock to be fed and retained regardless of the thickness of said stock.

Figure 2:
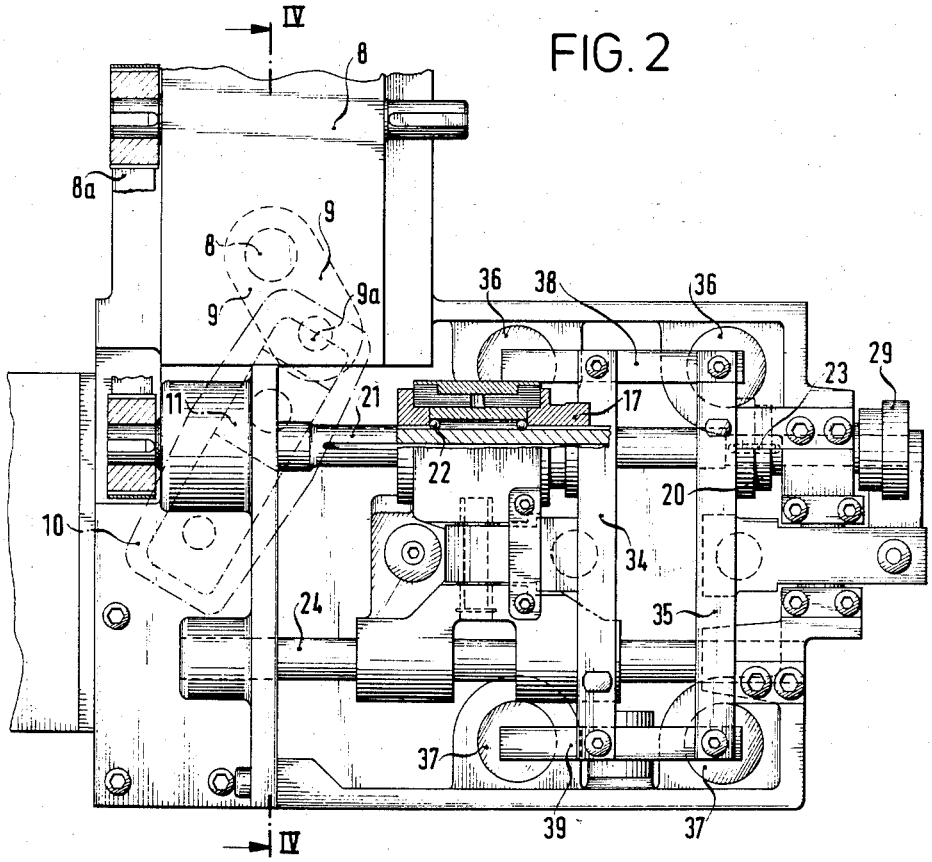
Figure 5:
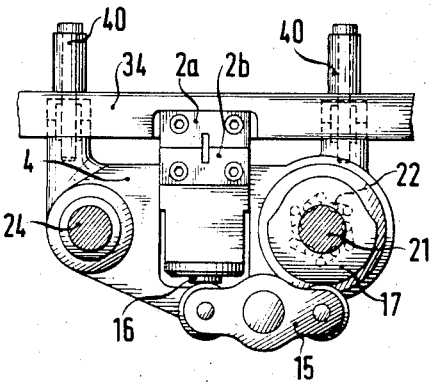
Figure 6:
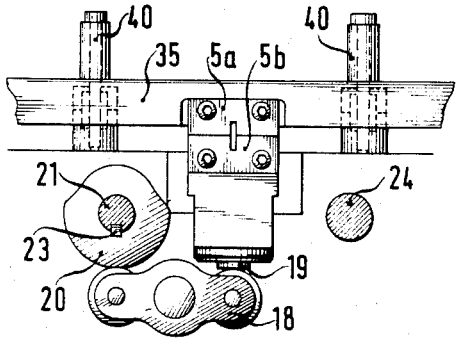
Figure 8:
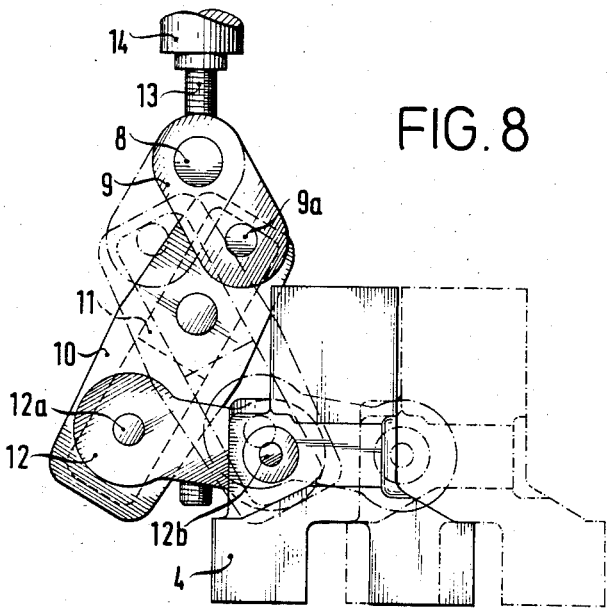
Figure 7:
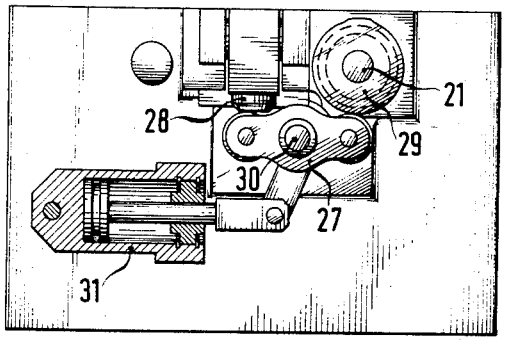

Further details of the feeding gripper according to the invention will become apparent from the following description of a preferred embodiment shown in the drawing, in which FIGS. 1 and 2 are, respectively, a central sectional view and a top plan view of a gripping feeder according to the invention, FIG. 3 is a transverse sectional view taken on line III—III of FIG. 1, FIG. 4 is a transverse sectional view taken on line IV—IV in FIG. 2, FIGS. 5 to 7 are several vertical longitudinal sectional views taken on lines A, B, C, respectively, in FIG. 1, and FIG. 8 is a top plan view showing the feed rocker.

The gripping feeder is driven from the main shaft of the machine via angle gear trains and an interposed telescopic shaft and is operated by said mechanism in step with the machine to perform an intermittent motion for feeding strip or wire stock 1 in step with the operation of the machine. The gripping feeder comprises a reciprocating feeding gripper 2, which includes gripping jaws 2*a*, 2*b* and is carried by a pivoted arm 3 to a carriage 4, and a stationary retaining gripper 5, which includes gripping jaws 5*a*, 5*b* and is connected by a gripping rocker 6 to the housing 7 of the feeder. As is particularly apparent from FIGS. 1 and 2, the carriage 4 carrying the feeding gripper 2 is driven from the main drive of the machine by means of a cam-controlled shaft 8 and a pivoted finger 9, to which an angular oscillation is imparted by the shaft 8 and which is connected to one end bearing 9*a* of a framelike feed rocker 10, which extends transversely to the direction of travel of the carriage 4 and is slidably mounted on a slider 11, which constitutes a displaceable fulcrum. The oscillating angular movement of the feed rocker 10 is transmitted to the carriage 4 as an reciprocating motion of the latter by means of a link 12, which is pivoted at one end by a bearing 12*a* to one arm of the feed rocker 10 and at its other end by a bearing 12*b* to the carriage 4. The slider 11 is pivoted to a slide block 11*a*, which cooperates with a screw 13 for displacing the slide block 11*a* transversely to the direction of travel of the carriage 4 so that the slider 11 is moved along the feed rocker 10 and the angular movement of the feed rocker 10 and the stroke length of the carriage 4 can be adjusted from the outside during the operation of the machine, e.g., by means of an adjusting motor 14. By means of a microcomputer controlled by a measuring system, the adjusting motor 14 can be automatically controlled to maintain a predetermined stroke length.

It is also apparent from the drawing that the arm 3 which is pivoted to the carriage 4 constitutes the movable gripping jaw 2*b* of the feeding gripper 2 and a first plunger 16 bears at one end on the pivoted arm 3 and at the other end on one arm of a first cam follower rocker 15, the other arm of which cooperates with a camwheel 17, which controls the opening and closing movements of the pivoted arm via the rocker 15 and the plunger 16. The gripping rocker 6 which is pivoted to the housing 7 of the feeder constitutes the movable gripping jaw 5*b* of the retaining gripper 5. A second plunger 19 bears at one end on one arm 6*a* of the gripping rocker 6 and at its other end on one arm of a second cam follower rocker 18, the other arm of which cooperates with a camwheel 20 for controlling the opening and closing movements of the gripping rocker 6 via the second cam follower rocker 18 and the second plunger 19.

By means of a toothed belt 8*a*, the main shaft of the machine drives also the adjusting shaft 21 on which the camwheel 17 is axially slidably and non-rotatably mounted and to which the camwheel 20 is axially immovably and non-rotatably secured. The camwheel 17 is slidably mounted and non-rotatably connected to the shaft 21 by means of a revolving linear guide ball bearing 22 so that the camwheel 17 is axially movable in unison with the carriage 4. The camwheel 20 is axially fixed and non-rotatably connected to the shaft 21 by the key 23. The adjusting shaft 21 and the guide rod 24, which is parallel to the shaft 21, constitute a track for guiding the carriage 4. The plungers 16 and 19, which are interposed between the cam follower rockers 15 and 18, respectively, and extend into recesses of the pivoted arm 3 and the rocker arm 6*a*, respectively, and which serve to close and open the grippers comprise mutually opposite end portions and compression springs 25, 26, respectively, which are interposed between the end portions of the associated plungers and the expension of which are limited by stops. As a result the movable jaws 2*b*, 5*b* of the feeding and retaining grippers 2, 5, respectively, will always properly engage the stock which is to be fed and retained, respectively, and that engagement will be independent of the thickness of the strip or wire stock 1 which is to be intermittently fed. When thick material 1 is to be fed, the interposed compression springs 25, 26 will cause the movable jaws 2*b*, 5*b* to engage the stock with a stronger force, as is desired.

The second arm 6*b* of the gripping rocker 6 is engaged by one end of a third plunger 28, which at its other end engages one arm of a releasing cam follower rocker 27, the other arm of which cooperates with a third camwheel 29, which is also non-rotatably connected to the shaft 21 and is adapted to open via the rocker 27 and the plunger 28 the retaining gripper 5 when the feeding gripper 2 is open. The releasing cam follower rocker 27 is mounted by means of an eccentric bearing 30, which is connected to a fluid-operable piston-cylinder device 31, which is operable to move the releasing cam follower rocker 27 between operative and inoperative positions. This is apparent from FIG. 7. The plunger 28 comprises an end portion bearing on the releasing cam follower rocker 27, another end portion extending into a recess of the second arm 6*b* of the gripping rocker 6, and a compression spring 32, which is interposed between said end portions. The movement of the plunger 28 is limited by a stop 33. When the arm 6*b* of the gripping rocker 6 is moved in a jaw-opening sense by the releasing cam follower rocker 27 and the plunger 28, the arm 6*a* of the rocker 6 will urge the plunger 16 in a sense to disengage the cam follower rocker 18 from the camwheel 20. An in-process release of the stock is required only when feeler pins are used for controlling the leveling of strip stock.

The pivoted cam follower finger 9 which is oscillated by the cam drive 8 and serves to oscillate the feed rocker 10 remains at rest during certain intervals of time between successive swings, i.e., between the mutually opposite strokes of the reciprocating carriage 4. During such rest periods the camwheels 17, 20 and, if desired, 29, driven via the control shaft 21 by the toothed belt 8*a* cause the feeding and retaining grippers 2, 5 to be actuated in phase opposition to each other by means of the cam follower rockers 15 and 18, respectively, and, if desired, by means of the releasing cam follower rocker 27. A reliable gripping of the strip is ensured because the times in which the opening and closing movements are imparted to the grippers 2 and 5 overlap during such rest period.

The stationary upper gripping jaws 2*a*, 5*a*, which cooperate with the movable gripping jaws 2*b* and 5*b* of the feeding and retaining grippers 2 and 5, respectively, are mounted on bridges 34, 35, respectively, which are operable by means of pairs of pneumatic piston-cylinder devices 36, 37 to jointly open the grippers 2, 5. The piston-cylinder devices 36, 37 of each pair are connected by a cross-beam 38 or 39. Pins 40 are connected to the bridges 34, 35 and are biased by springs, which oppose the movement of the bridges 34, 35 in the jaw-opening sense and tend to return the bridges 34, 35 to their initial position after the grippers 2 and 5 have been opened jointly.

I claim:

1. In a gripping feeder for an intermittent feeding of continuous stock in a predetermined direction in an intermittently operated machine for processing said stock, comprising a stationary retaining gripper, a carriage preceding said retaining gripper when viewed in said predetermined direction and reciprocable in and opposite to said predetermined direction, a feeding gripper mounted on and movable in unison with said carriage, a first actuating mechanism for opening and closing said retaining and feeding grippers in phase opposition to each other in step with the intermittent operation of said machine, and a second actuating mechanism for reciprocating said carriage and feeding gripper in and opposite to said predetermined direction in step with the intermittent operation of the machine, the improvement residing in that a rail is provided, which extends transversely to said predetermined direction, said second actuating mechanism comprises a feed rocker extending transversely to said predetermined direction, a slider, which is mounted on said feed rocker to be slidable along the same and along said rail and defines a fulcrum for said feed rocker, feed drive means for oscillating said feed rocker about said fulcrum, and transmitting means for reciprocating said carriage in and opposite to said predetermined direction in response to said oscillation of said feed rocker, and means are provided for holding said slider in a selected position relative to said rail so that the stroke length of said carriage depends on the position of said slider relative to said rail, wherein said feeding gripper comprises a movable jaw formed by a jaw arm pivoted to said carriage, and said first actuating mechanism comprises a camwheel, means for rotating said camwheel in step with the intermittent operation of said machine, a cam follower rocker having a first rocker arm cooperating with said camwheel and a second rocker arm, and a plunger bearing at one end on said second rocker arm and at the other end on said jaw arm, said means for rotating said camwheel comprise a rotary shaft extending in said predetermined direction, said camwheel being axially slidably mounted on and non-rotatably connected to said shaft, a guide rod is provided, which is parallel to said shaft and together with said shaft constitutes a track, and said carriage is slidably mounted on said track.

2. The improvement set forth in claim 1, wherein said plunger comprises mutually opposite end members engaging said rocker arm and jaw arm, respectively, and a compression spring interposed between said end members.

3. In a gripping feeder for an intermittent feeding of continuous stock in a predetermined direction in an intermittently operated machine for processing said stock, comprising a stationary retaining gripper pivotally mounted on a housing of said gripping feeder, a carriage preceding said retaining gripper when viewed in said predetermined direction and reciprocable in and opposite to said predetermined direction, a feeding gripper mounted on and movable in unison with said carriage, a first actuating mechanism for opening and closing said retaining and feeding grippers in phase opposition to each other in step with the intermittent operation of said machine, and a second actuating mechanism for reciprocating said carriage and feeding gripper in and opposite to said predetermined direction in step with the intermittent operation of the machine, the improvement residing in that a rail is provided, which extends transversely to said predetermined direction, said second actuating mechanism comprises a feed rocker extending transversely to said predetermined direction, a slider, which is mounted on said feed rocker to be slidable along the same and along said rail and defines a fulcrum for said feed rocker, feed drive means for oscillating said feed rocker about said fulcrum, and transmitting means for reciprocating said carriage in and opposite to said predetermined direction in response to said oscillation of said feed rocker, and means are provided for holding said slider in a selected position relative to said rail so that the stroke length of said carriage depends on the position of said slider relative to said rail, wherein said retaining gripper comprises a movable jaw formed by a second jaw arm, and said second actuating mechanism comprises a camwheel, means for rotating said camwheel in step with the intermittent operation of said machine, a cam follower rocker having a first rocker arm cooperating with said camwheel and a second rocker arm, and a plunger bearing at one end on said second rocker arm and at the other end on said jaw arm, wherein said jaw arm constitutes a third rocker arm, a gripping rocker having a fourth rocker arm, a release-controlling camwheel is provided, means are provided for rotating said release-controlling camwheel in step with the intermittent operation of said machine, a releasing cam follower rocker is provided, which has a fifth rocker arm cooperating with said release-controlling camwheel and a sixth rocker arm, and a releasing plunger is provided, which bears at one end on said fourth rocker arm and at the other end on said sixth rocker arm, said releasing cam follower rocker is fulcrumed to said housing by an eccentric bearing, and a fluid-operable piston-cylinder device is provided, which is operatively connected to said bearing and operable to move said releasing cam follower rocker between operative and inoperative positions.

* * * * *